US006981621B2

(12) United States Patent
Brandeis et al.

(10) Patent No.: US 6,981,621 B2
(45) Date of Patent: Jan. 3, 2006

(54) CAULKING GUN

(76) Inventors: Zeev Brandeis, 7 Alon Street, Rosh Ha'ayin (IL) 48560; Rony Granot, 38 Ha'Tzivoni Street, Kiryat Ono (IL) 55100

( * ) Notice: Subject to any disclaimer, the term of this patent is extended or adjusted under 35 U.S.C. 154(b) by 0 days.

(21) Appl. No.: 10/502,938

(22) PCT Filed: Jan. 29, 2003

(86) PCT No.: PCT/IL03/00071

§ 371 (c)(1),
(2), (4) Date: Mar. 7, 2005

(87) PCT Pub. No.: WO03/064056

PCT Pub. Date: Aug. 7, 2003

(65) Prior Publication Data

US 2005/0145653 A1 Jul. 7, 2005

Related U.S. Application Data

(60) Provisional application No. 60/352,238, filed on Jan. 29, 2002.

(51) Int. Cl.
*B67D 5/42* (2006.01)

(52) U.S. Cl. ..... 222/392

(58) Field of Classification Search ..... 222/392
See application file for complete search history.

(56) References Cited

U.S. PATENT DOCUMENTS 5,062,551 A * 11/1991 Goldstein et al. ..... 222/392
6,321,945 B1 * 11/2001 Girouard et al. ..... 222/392

* cited by examiner

*Primary Examiner*—Philippe Derakshani
(74) *Attorney, Agent, or Firm*—Edward Langer, Pat. Atty; Shiboleth, Yisraeli, Roberts, Zisman & Co.

(57) ABSTRACT

A caulking gun having a push rod-formed by two interlocking chains. The caulking gun comprises a barrel having an open framework for receiving and cradling a caulk cartridge. A self-contained drive mechanism is provided to forwardly advance a chain arrangement comprising two separately coiled chains, each composed of a series of individual links connected in pivotable fashion one to another. The shape of the individual links of the two chains enables them to be interlocked as one parallel chain, forming a push-rod to compress the caulk cartridge, for extrusion of material contained therein. The coiled chains enable the chain arrangement to bend 180 degrees, so that the overall caulking gun length is reduced. The caulking gun is preferably made entirely from plastic. A caulk cartridge is retained within the barrel of the device by a pair of locking clips which may be closed by a sliding ring mechanism.

20 Claims, 6 Drawing Sheets

CAULKING GUN

This application is a 371 of PCT/IL03/00071 Jan. 29, 2003 which claims benefit of 60/352,238 Jan. 29, 2002.

FIELD OF THE INVENTION

The present invention relates to dispensing devices and more particularly to an open-framed cartridge caulking gun having a push-rod formed by two interlocking chains.

BACKGROUND OF THE INVENTION

Caulk is a waterproofing material used by building contractors and homeowners for sealing windows, doors and bathtubs.

Caulk is most conveniently dispensed and applied using caulking guns, to which are fitted a plastic or cardboard tube containing caulk.

Two main types of caulking guns are known. The first is the bulk dispensing gun, which is a complete unit containing a closed cylindrical chamber with nozzle and actuating means. The second is the open framed cartridge gun, in which the gun itself and a disposable cartridge containing caulk comprise separate elements.

The open-framed cartridge gun typically comprises a cradle to receive a cartridge containing caulk, one end of the cartridge having a dispensing nozzle. A piston is provided within the cartridge. Caulk is dispensed by exerting pressure on a trigger of a pistol-grip mechanism, which actuates a push rod having a thrust disk at its front end. Pressure exerted by the thrust disk against the caulk cartridge piston forces caulking material out of the cartridge nozzle.

Many variations of the open-framed cartridge gun have been described in the art. In all of these, the push rod is at least as long as the cartridge, plus the distance the push rod must travel through the pistol-grip mechanism in order to be able to urge the thrust disk along the entire length of the cartridge. In addition, a small segment of the push rod must remain exposed after the cartridge has been depleted so that the exposed segment of the push rod can be grasped by hand and retracted to the starting position. The total length is further increased by the nozzle of the cartridge when full, resulting in a relatively long caulking gun. Such a device is awkward to handle and cannot easily fit into tight spaces such as cupboards, closets, behind doors etc.

In existing open-framed cartridge guns the cartridge is inserted by first retracting the push rod, then manually manipulating the cartridge into place. The cartridge is released by retracting the push rod while simultaneously pressing a release lever or button. These manipulations are awkward and time-consuming.

Therefore, it would be desirable to provide a cartridge caulking gun which is shorter and easier to manipulate than the prior art devices, and in which loading and removal of cartridges is simplified.

SUMMARY OF THE INVENTION

Accordingly, it is an object of the present invention to overcome the disadvantages of the prior art and provide a relatively short caulking gun, which is easy to manipulate.

In accordance with a preferred embodiment of the present invention, there is provided a caulking gun formed entirely of plastic, which eliminates the problems of rusting and general wear and tear associated with prior art devices. The caulking gun comprises a barrel having an open framework for receiving and cradling a caulk cartridge provided with an extrusion nozzle at one end. A drive mechanism is provided to forwardly advance a chain arrangement comprising two separately coiled chains, each composed of a series of individual hollow links connected in pivotable fashion one to another. The shape of the individual chain links of the two chains enable them to be interlocked as one parallel chain, forming a push-rod to compress the caulk cartridge piston, to empty it of material. The coiled chains enable the chain arrangement to bend 180 degrees, so that the overall caulking gun length is reduced by eliminating the backward protruding rod of the standard device.

According to a preferred embodiment, there is provided a caulking gun comprising an elongated body, a pair of chains situated within the elongated body in coiled fashion, the chains being fixedly interlocked one to another at a front end thereof, a coiled portion of the chains being reversibly interlockable one to another to form a push-rod when extended, a disk-shaped element attached to the push-rod, a self-contained driving mechanism for graduated extension of the coiled portion of the pair of chains in parallel interlocked fashion, forming the push-rod, and a release mechanism for restoring the pair of parallel chains to their fully retracted, coiled position, such that by repeated activation of the driving mechanism, the coiled chains are brought into interlocking contact one with the other, increasing the length of the push-rod, thereby carrying the disk element forward against a caulk cartridge inserted within the elongated body, causing extrusion of material contained in the cartridge.

A feature of the present invention is that the push-rod of the caulking gun is formed by interlocking of two parallel chains.

An advantage of the present invention is that the caulking gun is shorter than conventional devices and therefore easier to manipulate.

A further advantage of the present invention is that loading and removal of the cartridge of the caulking gun is rapid and simple.

A further advantage of the present invention is that the device is extremely lightweight.

A further advantage of the present invention is that the device requires less storage space than prior art devices.

A further advantage of the present invention is that the device is formed entirely of plastic, therefore no rusting occurs.

A further advantage of the present invention is that it does not include a protruding push-rod, and is therefore safer to use than conventional devices.

A further advantage of the present invention is that the operating mechanism is closed, eliminating problems of exposure to dirt and other harmful matter.

A further advantage of the present invention is that the device is operable with one hand.

A further advantage of the present invention is that a caulking cartridge may be quickly inserted and removed from the device by operation of a slidable locking mechanism.

Additional features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding sections or elements throughout, and in which.

DETAILED DESCRIPTION OF THE PREFERRED EMBODIMENTS

Figure 1:
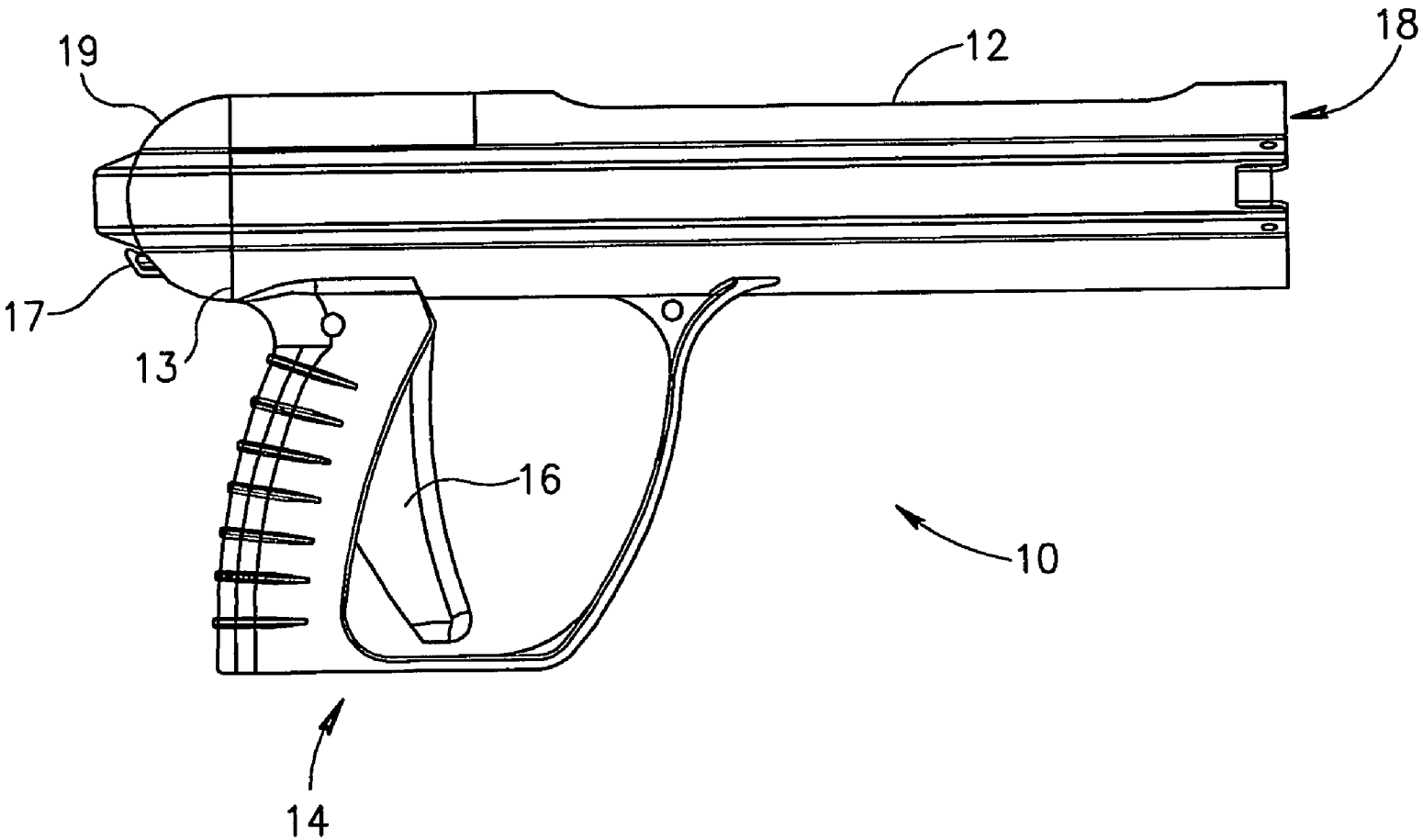
FIG. 1 is a side view of a caulking gun constructed and operated in accordance with the principles of the present invention.
Figure 2A:
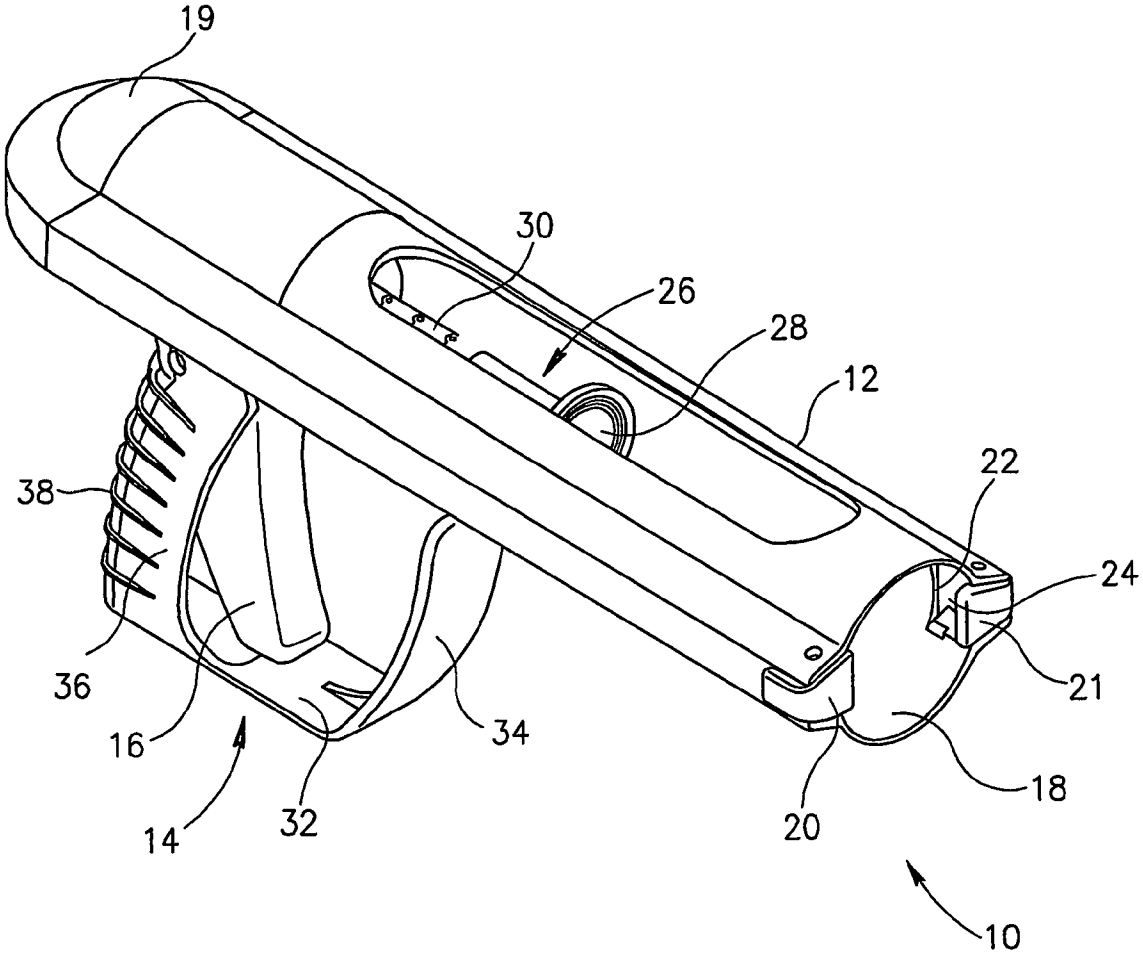
FIG. 2*a* is a perspective view of the caulking gun of FIG. 1.
Figure 2B:
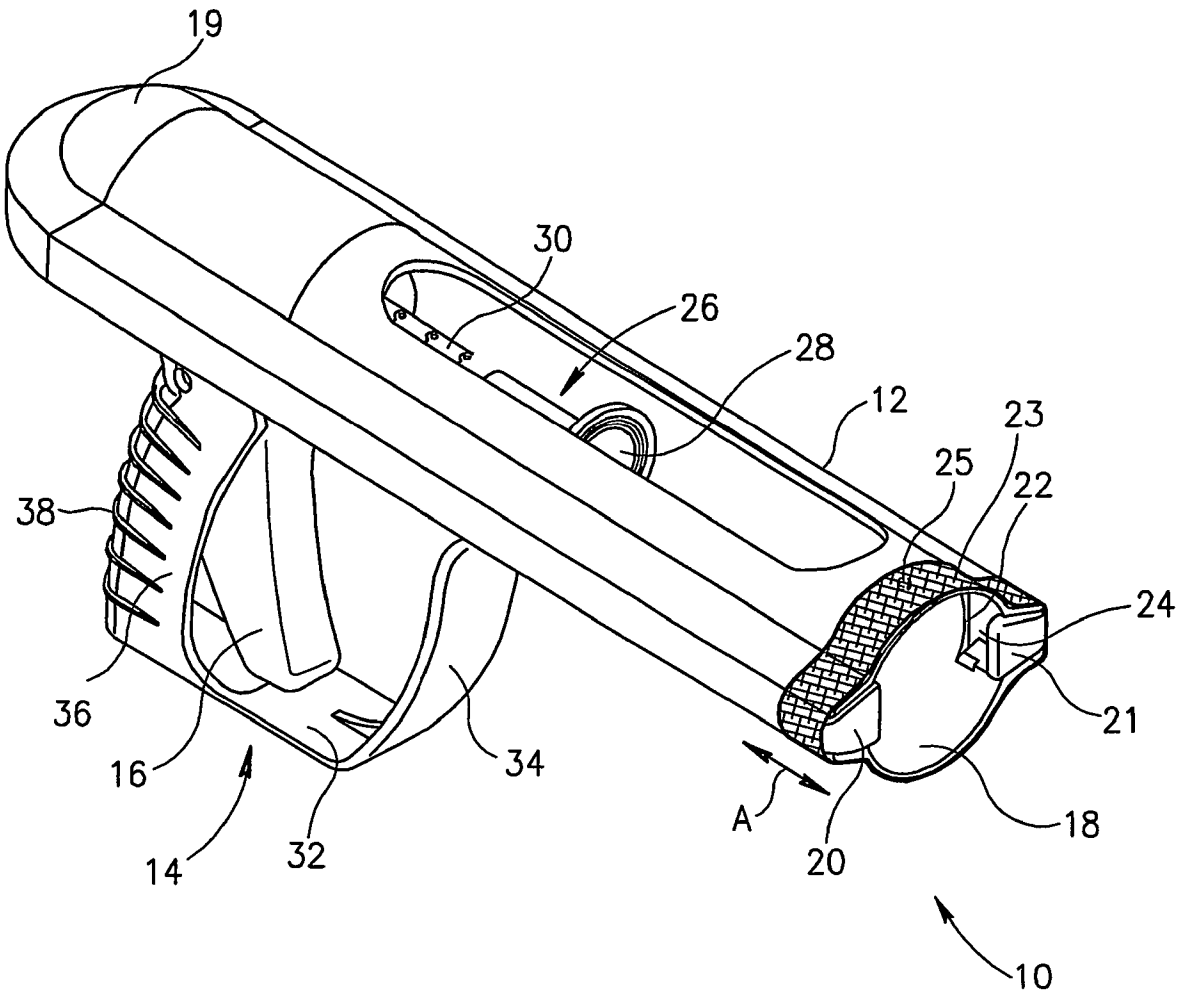
FIG. 2*b* is a perspective view of an alternative embodiment of the caulking gun of FIG. 1.

Reference is now made to FIGS. 1, 2*a* and 2*b*, which illustrate the caulking gun 10 of the present invention.

Figure 3:
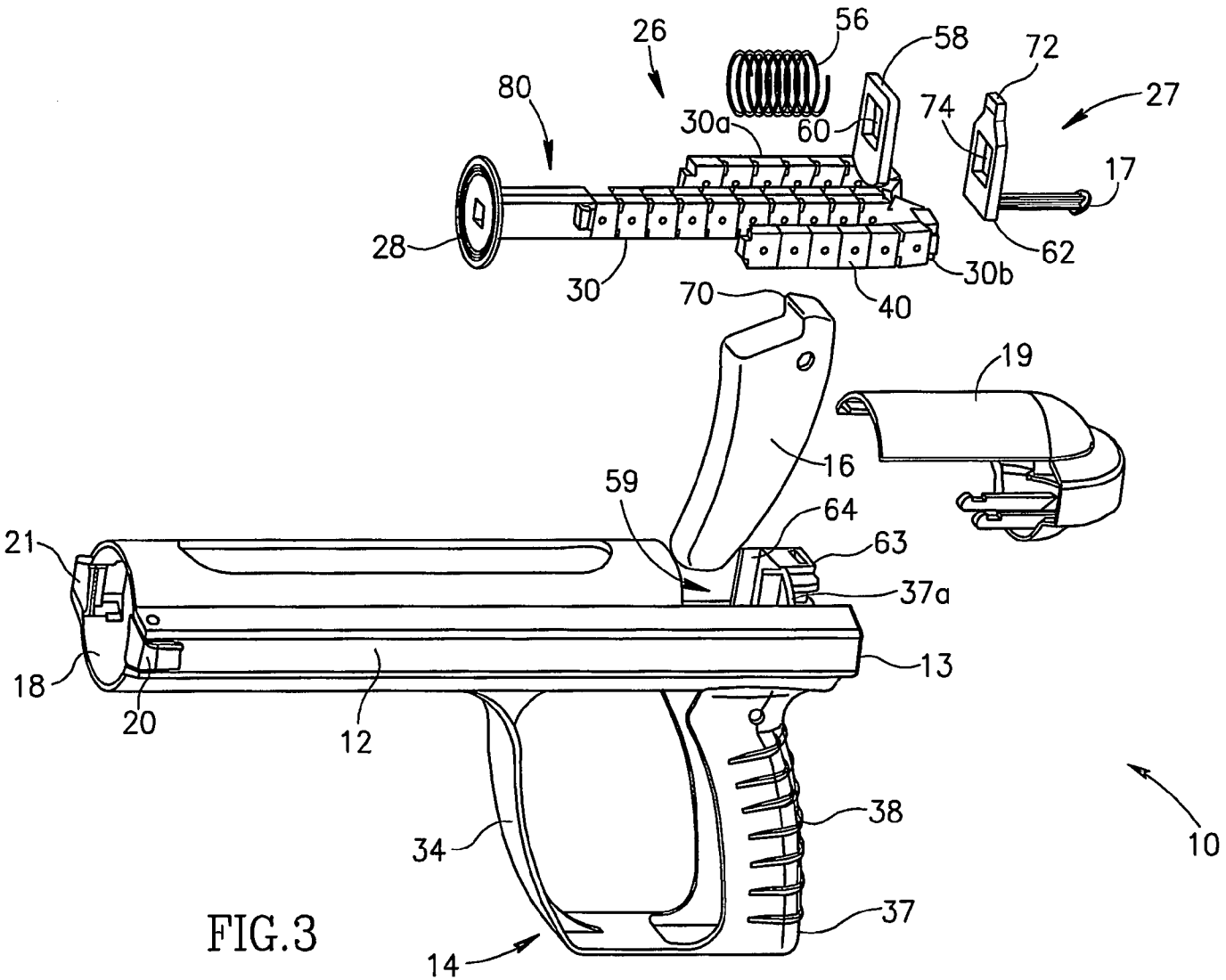
FIG. 3 is an exploded view of the caulking gun.
Figure 4:
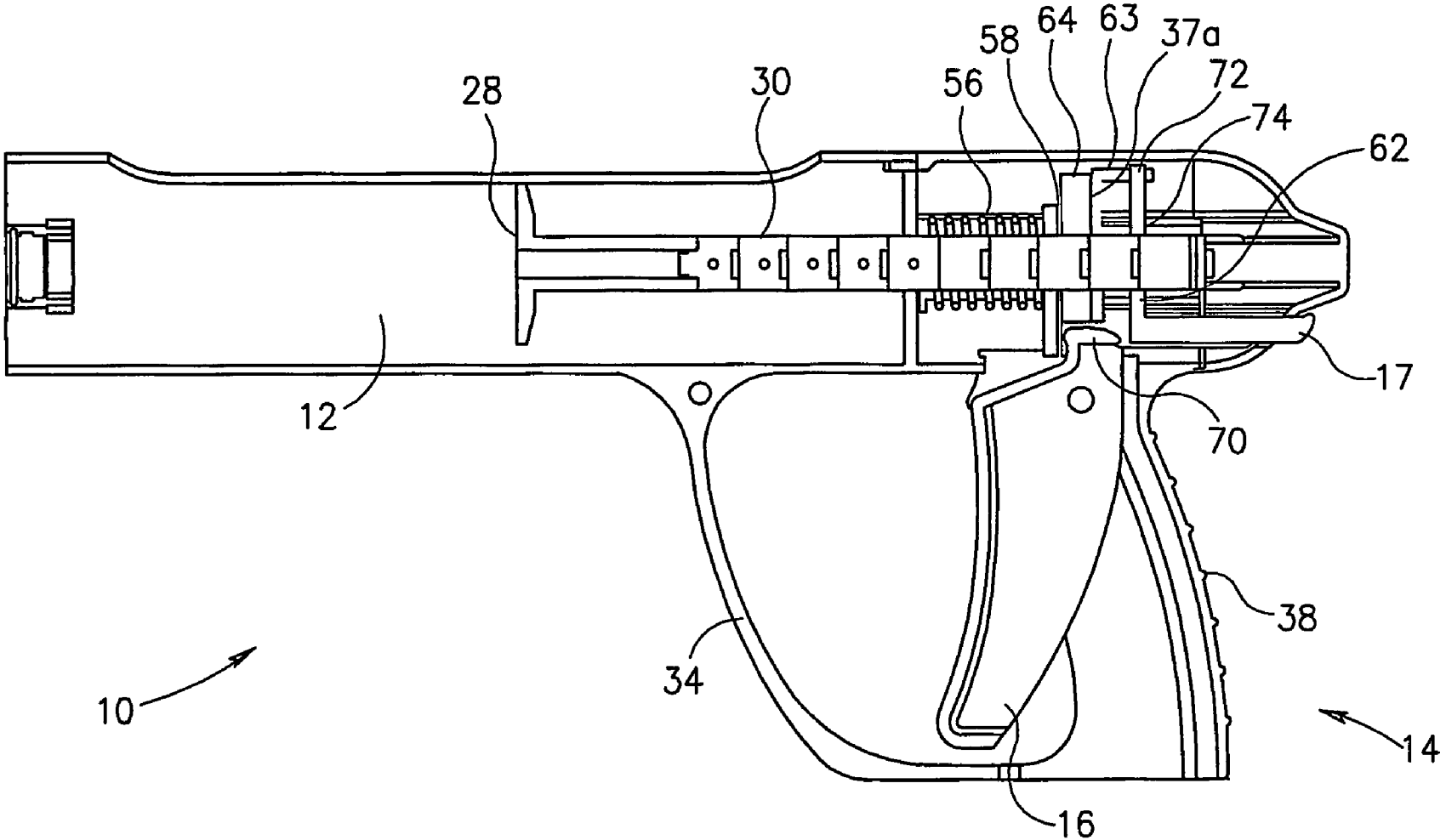
FIG. 4 is a cross-sectional side view of the caulking gun.
Figure 5:
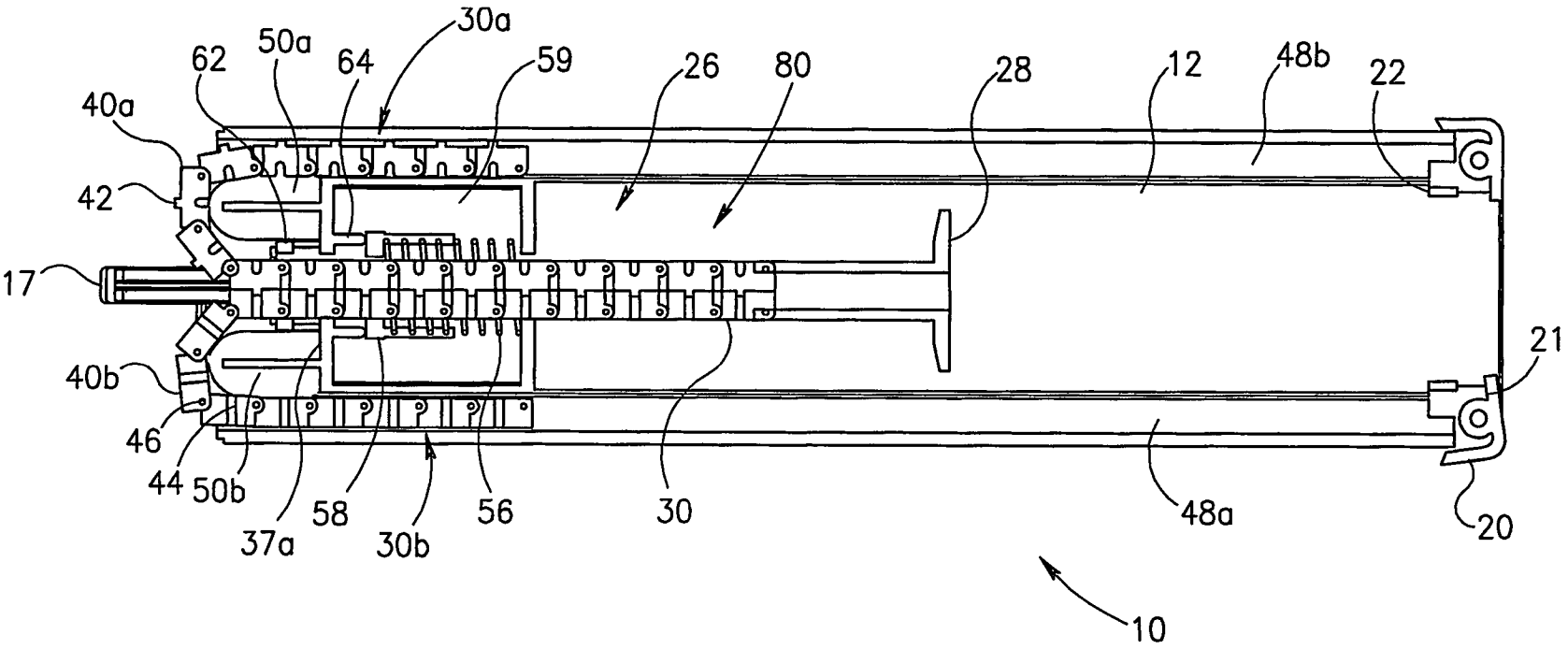
FIG. 5 is a cross-sectional top view of the caulking gun.

Caulking gun 10 comprises a barrel 12, having a rear edge 13, a handle 14 extending essentially perpendicular to barrel 12, and a trigger 16 positioned within handle 14 for operating a drive mechanism 26 (shown in FIGS. 3–5). A removable closure 19 is attached to wall 13.

Caulking gun 10 is formed entirely of plastic such as fiberglass-reinforced polypropylene, fiberglass-reinforced polycarbonate or fiberglass-reinforced nylon. Use of plastic eliminates the problems of rusting and general wear and tear associated with prior art devices.

Barrel 12 comprises a slightly flattened tube having an open framework for receiving and cradling a caulk cartridge or canister (not shown) provided with an extrusion nozzle at one end.

The forward end of barrel 12 is provided with an open end 18 through which the nozzle of the caulk cartridge is able to protrude. A pair of L-shaped locking clips 20 are pivotally mounted one on either side of open end 18, such that when clips 20 are in the locked position, a recess 24 is formed between flange 21 of clip 20 and an internal protrusion 22, situated perpendicular to the axis of barrel 12.

With clips 20 in the open position, the caulk cartridge (not shown) is inserted into open end 18 with extrusion nozzle directed outwards, until its rim contacts internal protrusion 22. Clip 20 is then closed such that the cartridge rim is firmly held in position in barrel 12 within recess 24.

In an alternative embodiment, shown in FIG. 2*b*, a contoured ring 23 is positioned around open end 18 of barrel 12, enclosing clips 20 to prevent accidental opening of clips 20. Ring 23 is fixed in position by engaging pin 25, which may be released to enable ring 23 to be slidingly displaced away from the direction of open end 18 (see arrow "A"), thereby releasing clips 20. This enables a caulk cartridge (not shown) to be rapidly loaded into and removed from barrel 12.

Caulking gun 10 also includes a drive mechanism 26 and release mechanism 27, described in detail below, which are situated within barrel 12 and activated by trigger 16 and release button 17, respectively. Trigger 16 and release button 17 are both operable with the same hand, such that upon completion of caulk extrusion, release button 17 may be depressed to release residual pressure within the cartridge, thereby preventing dripping of excess caulk.

Handle 14 is an open frame comprising a horizontal lower surface 32 attached to a substantially perpendicular front-facing surface 34, which connects lower surface 32 to barrel 12. Trigger 16 is positioned within the hollow rear section 36 of handle 14. Rear section 36 A plurality of short, raised, strips 38 are formed along the length of sides 36 to enable a non-slip pistol grip.

Referring now to FIGS. 3 to 5, the drive mechanism 26 and release mechanism 27 are shown.

Rear surface 37 of handle 14 extends upwards into barrel 12, forming an edge 37*a*. Drive mechanism 26 is positioned forward of edge 37*a* and release mechanism 27 is pivotally attached to a flange 63 extending backwards from edge 37*a*.

Drive mechanism 26 comprises a thrust disk 28 positioned at the forward end of a chain arrangement 30, a biasing spring 56 positioned over chain arrangement against a jam plate 58, seated in compartment 59. Jam plate 58 is formed with a window 60 through which chain 30 passes. Drive mechanism 26 is actuated by trigger 16, formed with a tapering lower end and a push tab 70 at its upper end.

Chain arrangement 30 comprises two separate chains 30*a*, 30*b*, each composed of a series of individual hollow links 40 connected in pivotable fashion one to another. As seen in FIG. 5, each link 40*a* of chain 30*a* is provided with a tab 42 and a notch 44, insertable within a complementary notch 44 formed on each link 40*b* of parallel chain 30*b*. Adjacent links 40 are each pivotable about pin 46, which enables each chain 30*a*, 30*b* of chain arrangement 30 to bend 180 degrees, as shown in FIG. 3.

Barrel 12 is further provided with two parallel elongated channels 48*a*, 48*b* (FIG. 5), which run adjacent to the inner wall of barrel 12, each having a width sufficient to enable seating of links 40 of a respective one of chains 30*a*, 30*b* therewithin. Channels 48*a*, 48*b* terminate at internal protrusion 22, described above with reference to FIGS. 2*a* and 2*b*.

The end of barrel 12 towards which trigger 16 is situated is provided with a pair of circular guides 50*a*, 50*b* around which pass links 40 of chains 30*a* and 30*b* respectively.

Guides 50*a* and 50*b* are spaced at a suitable distance one from the other such that when chains 30*a*, 30*b* pass around guides 50*a*, 50*b* respectively, the two chains 30*a*, 30*b* are forced into contact one with the other in the region between the two guides 50*a*, 50*b*.

Links 40 of chain 30*a* are each formed with a side protrusion 42, extending towards parallel chain 30*a*, and insertable within a complementary recess 4*s*4 formed on the side surface of each link 40 of chain 30*b* facing chain 30*a*, such that by forcing the chains into contact, they become firmly interlocked as one.

This firm interlock between chains 30*a*, 30*b*, forms a solid, inflexible rod which serves as a push-rod 80 for driving thrust disk 28 forward.

In operation, when trigger 16 is depressed in the direction of rear section 36 of handle 14, push tab 70 of trigger 16 is pushed forward against a lower edge of jam plate 58, causing jam plate 58 to slant backwards from an axis perpendicular to that of chain 30, and to pivot within channel 64. Due to the inclined orientation of jam plate 58 on chain 30, links 40 of chain 30 become engaged with an edge of window 60. Thus, as jam plate 58 moves, chain 30 moves together with it, advancing in a forward direction, against the action of spring 56. Upon release of trigger 16, jam plate 58 returns to a vertical orientation by the action of spring 56, releasing chain 30. Jam plate 58 returns to its original position while chain 30 remains in the position to which it has been advanced by operation of trigger 16.

Once the caulking cartridge has been used, whether it has been emptied or if it is to be stored for re-usage, it may be removed easily from caulking gun 10 by releasing locking clips 20.

Release mechanism 27 comprises a locking plate 62, pivotally attached at its upper end 72 to flange 63. Locking plate 62 is formed with a window 74 and is positioned so as to slant backwards from attachment point at upper end 72. Chain 30 is therefore held firmly by the edges of window 74 of locking plate 62, preventing chain 30 from retracting and returning to its original position after release of trigger 16. Upon exertion of pressure on release button 17, the lower end of locking plate 62 of release mechanism 27 moves forwards, causing locking plate 62 to straighten vertically from the inclined angle, resulting in disengagement of chain 30. Chain 30 may then be manually retracted by exertion of pressure upon thrust disk 28.

The entire drive mechanism 26 is enclosed within a suitably shaped, removable, snap-on covering 19 which provides protection from exposure to dust and other airborne particles, oil, water etc. which could decrease the efficiency of the mechanism.

The present invention therefore provides a caulking gun 10 in which the push-rod 80 is formed by two retractable, interlocking chains 30*a–b*, enabling the gun to be designed with significantly reduced length in comparison with standard caulking guns, based on use of a self-contained driving mechanism. The resulting gun is simple to use and is easy to manipulate in small, confined spaces. Less storage space is also required. The absence of a protruding push-rod renders the caulking gun 10 safer to use.

The plastic composition of caulking gun 10 eliminates the problem of rusting which is common in conventional caulking guns and provides and extremely lightweight device. Furthermore, plastic is less susceptible to general wear and tear which occur as a result of repeated use.

Having described the invention with regard to certain specific embodiments thereof, it is to be understood that the description is not meant as a limitation, since further modifications will now suggest themselves to those skilled in the art, and it is intended to cover such modifications as fall within the scope of the appended claims.

We claim:

1. A caulking gun comprising:

an elongated body having an open front end;

a pair of chains situated within said elongated body in coiled fashion, said chains being fixedly interlocked one to another at a front end thereof, a coiled portion of said chains being reversibly interlockable one to another to form a push-rod when extended;

a disk-shaped element attached to said front end of said push-rod;

a self-contained driving mechanism for graduated extension of said coiled portion of said pair of chains in parallel interlocked fashion, forming said push-rod; and a release mechanism for restoring said pair of parallel chains to their fully retracted, coiled position, such that by repeated actuation of said driving mechanism, said coiled chains are brought into interlocking contact one with the other, increasing the length of said push-rod, thereby carrying said disk element forward against a caulk cartridge inserted within said elongated body, causing extrusion of material contained within said cartridge.

2. The caulking gun of claim 1 further comprising a handle downwardly extending from said body.

3. The caulking gun of claim 2 wherein said driving mechanism comprises a trigger positioned within said handle, said trigger being provided with a push tab at its upper edge.

4. The caulking gun of claim 3 wherein said driving mechanism further comprises:

a biasing spring; and a vertically-oriented driving jam plate formed with a window for insertion therethrough of said parallel chains, such that upon exertion of pressure on said trigger, said push tab causes said driving jam plate to become inclined at an angle, engaging said interlocked parallel chains within said window of said jam plate, and forwardly displacing said push-rod against the action of said biasing spring.

5. The caulking gun of claim 4 wherein said release mechanism comprises:

a backwardly inclined locking plate provided with a hole for insertion therethrough of said parallel chains; and a release button, such that upon release of said trigger, said jam plate returns to a vertical position by the action of said biasing spring, releasing said interlocked parallel chains, and such that exertion of pressure on said release button causes said inclined locking plate to be moved to a vertical position, thereby releasing engagement with said parallel chains and enabling said interlocked parallel chains to be returned to their original position by exerting pressure on said disk-shaped element.

6. The caulking gun of claim 5 wherein exertion of pressure on said release button enables release of residual pressure within the cartridge, thereby preventing dripping of excess caulk.

7. The caulking gun of claim 1 wherein said elongated body is provided with a pair of oppositely-situated channels running parallel to the inner side walls of said elongated body, such that each of said pair of parallel chains is retained within one of said parallel channels.

8. The caulking gun of claim 1 wherein a pair of guide wheels are oppositely positioned rearward of said driving mechanism, adjacent to said pair of chains and separated by a distance corresponding to the width of said interlocked parallel chains, such that said pair of guide wheels force said pair of parallel chains into linked contact in the region between two said circular elements.

9. The caulking gun of claim 1 wherein each of said pair of chains comprises a plurality of pivotally connected box-shaped links.

10. The caulking gun of claim 9 wherein each of said links is provided with a protruding tab on an inwardly-facing vertical face and a recessed notch formed on an oppositely situated vertical face, such that said tab of one of said links of a first of said parallel chains is insertable within said notch of an adjacent of said links of said second parallel chains.

11. The caulking gun of claim 10 wherein said links are hollow.

12. The caulking gun of claim 1, formed entirely of plastic.

13. The caulking gun of claim 1 wherein said elongated body comprises a slightly flattened tube having an open framework for receiving therein said caulk cartridge.

14. The caulking gun of claim 1 wherein said elongated body is provided with at least a pair of locking clips oppositely mounted on either side of said open end of said elongated body for fixedly retaining a front rim of said caulk cartridge.

15. The caulking gun of claim 14 wherein said locking clips are pivotally mounted.

16. The caulking gun of claim 15 further provided with a contoured disc slidingly positioned over said open front end of said elongated body so as to releasably engage said locking clips.

17. The caulking gun of claim 2 wherein said handle is an open-frame.

18. The caulking gun of claim 17 wherein said handle is provided with a plurality of raised non-slip strips along an outer rear side.

19. The caulking gun of claim 1, having significantly reduced length.

20. A method for extruding caulk contained within a caulking gun, comprising the steps of:

providing a caulking gun comprising an elongated body having an open front end, a pair of chains situated within said elongated body in coiled fashion, said chains being fixedly interlocked one to another at a front end thereof, a coiled portion of said chains being reversibly interlockable one to another to form a push-rod when extended, a disk-shaped element attached to said front end of said push-rod; a driving mechanism for graduated extension of said coiled portion of said pair of chains in parallel interlocked fashion, forming said push-rod, and a release mechanism for restoring said pair of parallel chains to their fully retracted, coiled position;

inserting a caulk cartridge provided with an extrusion nozzle at one end within said elongated body; and repeatedly actuating said driving mechanism, such that said coiled chains are brought into interlocking contact one with the other, increasing the length of said push-rod, thereby carrying said disk element forward against the caulk cartridge inserted within said elongated body, causing extrusion of the caulk contained within the cartridge from said extrusion nozzle.

* * * * *